US005662045A

United States Patent [19]

Miller et al.

[11] Patent Number: 5,662,045

[45] Date of Patent: Sep. 2, 1997

[54] LOCOMOTIVE FOR MATERIAL HANDLING TRAIN

[75] Inventors: Charles E. Miller; John Strand; James J. Gould, all of Ann Arbor, Mich.

[73] Assignee: Symorex, Ltd., Ann Arbor, Mich.

[21] Appl. No.: 524,401

[22] Filed: Sep. 6, 1995

[51] Int. Cl.[6] ..... B61C 11/00

[52] U.S. Cl. ..... 105/30; 105/75; 105/141; 104/118

[58] Field of Search ..... 104/93, 118, 119; 105/30, 72, 73, 75, 141, 144

[56] References Cited

U.S. PATENT DOCUMENTS

| | | | |
|---|---|---|---|
| 8,166 | 6/1851 | Griggs . | |
| 353,714 | 12/1886 | Shaw . | |
| 850,804 | 4/1907 | Steffee . | |
| 3,176,628 | 4/1965 | Reid | 105/72 |
| 3,540,381 | 11/1970 | White, Jr. | 105/75 |
| 3,584,583 | 6/1971 | Cartwright | 105/144 |
| 3,648,617 | 3/1972 | Metzner et al. | 105/73 |
| 3,675,583 | 7/1972 | Sobey et al. | 105/30 |
| 4,260,869 | 4/1981 | Slavens et al. | 105/30 |
| 4,423,685 | 1/1984 | Kerckhoff | 105/150 |
| 4,671,183 | 6/1987 | Fujita et al. | 104/118 |
| 4,794,866 | 1/1989 | Brandis et al. | 104/292 |
| 5,018,928 | 5/1991 | Hartlepp | 414/339 |
| 5,069,141 | 12/1991 | Ohara et al. | 105/30 |
| 5,235,917 | 8/1993 | Luck et al. | 104/119 |
| 5,303,656 | 4/1994 | Makimura et al. | 105/144 |

OTHER PUBLICATIONS

"Sortation Conveyor" by Industrial Equipment News, Nov. 1991 (1 pg.).

"NovaSort—Engineered to Meet Your Needs" by Amphion, Inc., 1991 (4 pgs.).

"This Is Not Your Father's Material Handling System" Production/Dec., 1993, by Gary S. Vasilash (pp. 52–53).

"Trains of Trays: A New Approach to Conveying", Modern Materials Handling, Aug. 1991 (p. 85).

*Primary Examiner*—S. Joseph Morano

*Attorney, Agent, or Firm*—Young & Basile, P.C.

[57] ABSTRACT

An automated material handling system including one or more train assemblies moving along a rail with each train assembly including a locomotive pulling a plurality of trolley cars. The locomotive includes a front truck adapted for movement along the rail; a rear truck adapted for movement along the rail in spaced trailing relation to the front truck; a body structure mounted on and extending between the front and rear trucks; a tractor positioned between the front and rear trucks, disassociated from the body structure, and including a motor and a traction drive wheel driven by the motor and adapted to drivingly engage the rail; and a link pivotally interconnecting the tractor and the rear truck. The body structure defines a central downwardly opening compartment between the front and rear trucks and the tractor is positioned in the compartment. The tractor is thus free to essentially independently perform the pulling function for the train without concern for the carrying function of the locomotive. The tractor also includes a guide wheel coacting with the drive wheel of the locomotive to exert a clamping force on the rail and a traction control mechanism operative in response to variations in the draft load applied to the tractor by the associated train to vary the clamping force and thereby the locomotive traction.

31 Claims, 6 Drawing Sheets

LOCOMOTIVE FOR MATERIAL HANDLING TRAIN

FIELD OF THE INVENTION

The invention is generally related to automated material handling systems utilizing one or more train-type guided vehicles transporting goods between induction and discharge stations in a sortation system.

BACKGROUND OF THE INVENTION

Automated material handling and sortation systems are known for receiving, transporting and discharging goods among various stations in large scale sortation operations such, for example, as warehousing, distribution, postal sortation and handling of mail and packages, and airport baggage handling. Whatever the operation, goods typically originate from one location within the facility and must be sorted and transported to several different locations for further handling, or originate from several locations within a facility and must be transported to a single location such as a shipping dock. The manner in which the various goods are stored and selectively distributed among various stations in a facility of course depends on the nature of the operation.

One known sortation and delivery method involves using powered belt or roller conveyers to transport individual items or sorted loads of items to various destinations within a facility. When goods from multiple sources must be delivered to a single station, associated take away conveyors must be merged onto a main conveyor or discharge point. This requires careful coordination of each item as it arrives to prevent jams or damage. Each merge point on such a conveyor system accordingly requires a complex system of sensors, start/stop controls, actuators, power supply lines, etc. Similarly, when items must be delivered to multiple destinations or stations in a facility, a main conveyor must be provided with diverter apparatus to direct individual items or batches of items to either continue or be diverted at various points. Each diverter apparatus requires an additional closed system including sensors, actuators, control mechanisms, wiring power supply to accomplish the diverting operation and track and identify the items being diverted.

The disadvantages of conveyor-type systems have led to the development of tracked systems in which a closed loop track carries cars propelled by a continuous chain drive. The cars are equipped with open trays which can be loaded from belts or chutes, and subsequently tilted to unload their carloads into bins which are located around the track. Such systems are designed for long term installations which sort and transport large volumes of goods. Although these closed loop track systems are an improvement over conveyor-type systems, the complexity of their track, drive and tilting mechanisms makes it a major undertaking to set them up or rearrange their sortation layout. Further, they must be totally shut down for nearly all maintenance tasks.

An improvement over continuous belt or chain drive closed loop track systems is disclosed in U.S. Pat. No. 5,018,928 issued to Hartlepp and assigned to the assignee of the present invention. Hartlepp discloses a train-type automated track sortation system, including a number of trolley cars and a locomotive or tug for pulling the cars around the track between various discharge and induction stations. The cars on the train are loaded with goods to be sorted or delivered and given destination addresses for the goods at an induction or loading station. Once a train has left the loading station, functions such as keeping track of position, regulating speed and dumping cars are controlled by a microprocessor placed aboard each locomotive.

Although train-type automated track sortation systems of the type disclosed by Hartlepp represent an improvement over conveyor-type and belt or chain-driven track systems, there is need for an improved tug or locomotive to pull the train. Prior art tugs or locomotives typically include front and rear trucks supporting the locomotive and a traction or drive unit incorporated in one of the trucks. Whereas this arrangement is generally satisfactory, it in effect integrates two distinct functions-the provision of a pulling force for the train and the provision of a support for the main body of the locomotive-in a single unit with the result that neither function can be optimized.

SUMMARY OF THE INVENTION

This invention is directed to the provision of an improved locomotive or tug for a material handling train.

More specifically, this invention is directed to the provision of a locomotive or tug for a material handling train in which the pulling and carrying functions of the locomotive are separated so as to allow optimization of each function.

The invention relates generally to a material handling system including a rail and a train moveable along the rail and including a locomotive pulling one or more cars.

According to an important feature of the invention, the locomotive includes a locomotive subassembly comprising a truck adapted for movement along the rail and a body structure defining a hollow and mounted on the truck; a tractor positioned within the hollow of the body structure, free to move laterally relative to the body structure, and including a motor and a traction drive wheel driven by the motor and adapted to drivingly engage the rail; and drive means drivingly interconnecting the tractor and the locomotive subassembly. This basic arrangement allows separation of the pulling and carrying functions of the locomotive so that each function may be optimized.

According to a further feature of the invention, the drive means drivingly interconnects the tractor and the truck. This specific interconnection further facilitates the separation of the pulling and carrying functions.

According to a further feature of the invention, the drive means comprises a link pivotally connected at one end thereof to the tractor and pivotally connected at another end thereof to the truck. This specific linkage allows the tractor to function substantially independently of the remainder of the locomotive so as to allow the tractor to perform its pulling function without concern for the carrying function of the locomotive.

According to a further feature of the invention, the locomotive truck comprises a front truck; the locomotive further includes a rear truck adapted for movement along the rail and spaced in trailing relation to the front truck; the body structure is mounted on and extends between the front and rear trucks; and the tractor is positioned between the front and rear trucks. This specific arrangement allows the spaced front and rear trucks to smoothly support the body structure and thereby optimize the carrying function of the locomotive while allowing the tractor to function independently, in the space between the front and rear trucks, to perform the pulling function.

In the disclosed embodiment of the invention, the body structure defines a downwardly opening compartment between the front and rear trucks and the tractor is positioned on the rail between the front and rear trucks and extends upwardly into the compartment. This specific arrangement provides a compact and efficient locomotive package in which the tractor is effectively disassociated from the body so that the pulling and carrying functions are totally separated.

According to a further feature of the invention, the traction drive wheel of the tractor is adapted to drivingly engage a first surface of the rail; the tractor further includes an opposing guide wheel adapted to drivingly engage a second surface of the rail opposed to the first surface; the drive wheel and the guide wheel coact to exert a clamping force on the rail and propel the tractor and an associated material handling train along the rail; and the locomotive further includes traction control means operative in response to variations in the draft load applied to the tractor by the associated train to vary the clamping force. This arrangement allows the clamping force, and thereby the traction, developed at the driving wheels to be selectively varied in response to, for example, acceleration, hill climbing, and braking.

According to a further feature of the invention, the traction control means includes a draw bar mounted on the tractor, receiving the draft load, and movable relative to the tractor in response to variations in the draft load; and the traction control means is operative to vary the clamping force in response to movement of the draw bar relative to the tractor. This arrangement defines a convenient and compact structure for providing the desired variations in the clamping and thereby the traction force. In the disclosed embodiment of the invention, the traction control means includes a cam bar secured to the draw bar and defining a cam surface and a cam follower connected to the guide wheel and coacting with the cam bar in response to movement of the draw bar relative to the tractor to raise and lower the guide wheel and thereby vary the clamping force.

DETAILED DESCRIPTION OF THE PREFERRED EMBODIMENT

Figure 1:
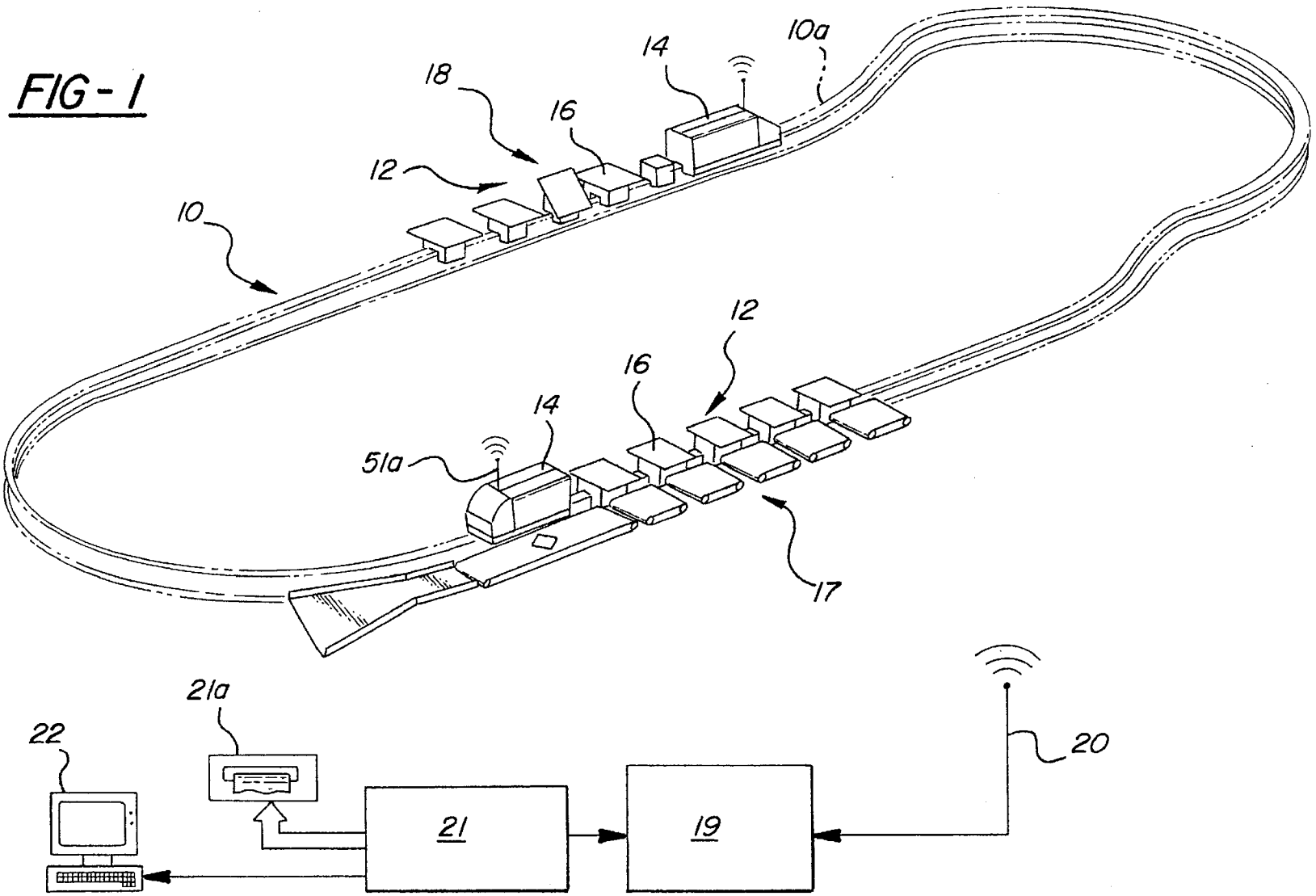
FIG. 1 is a perspective view of a material handling system according to the invention.
Figure 6:
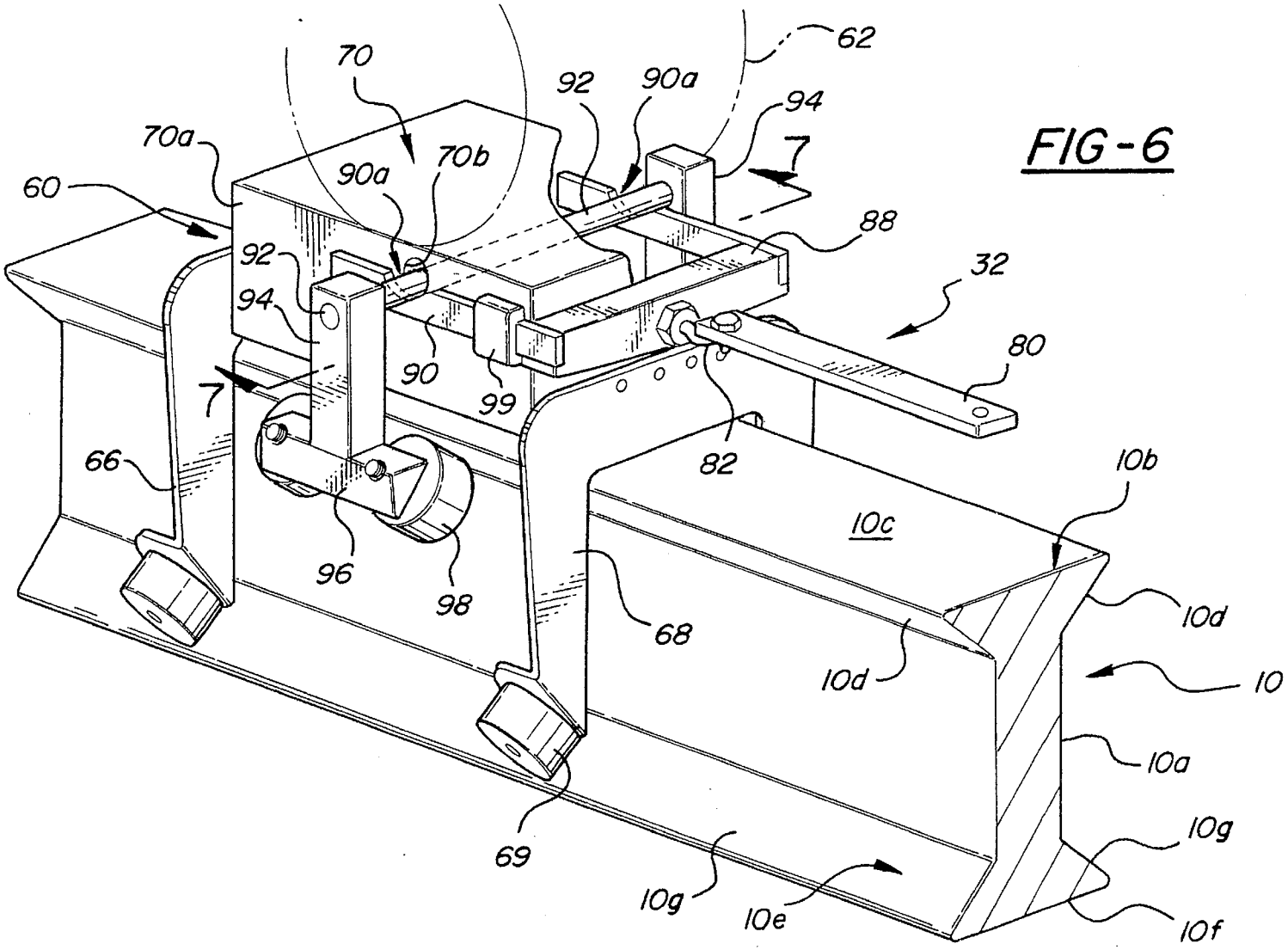
FIG. 6 is a fragmentary perspective view of the locomotive.
Figure 7:
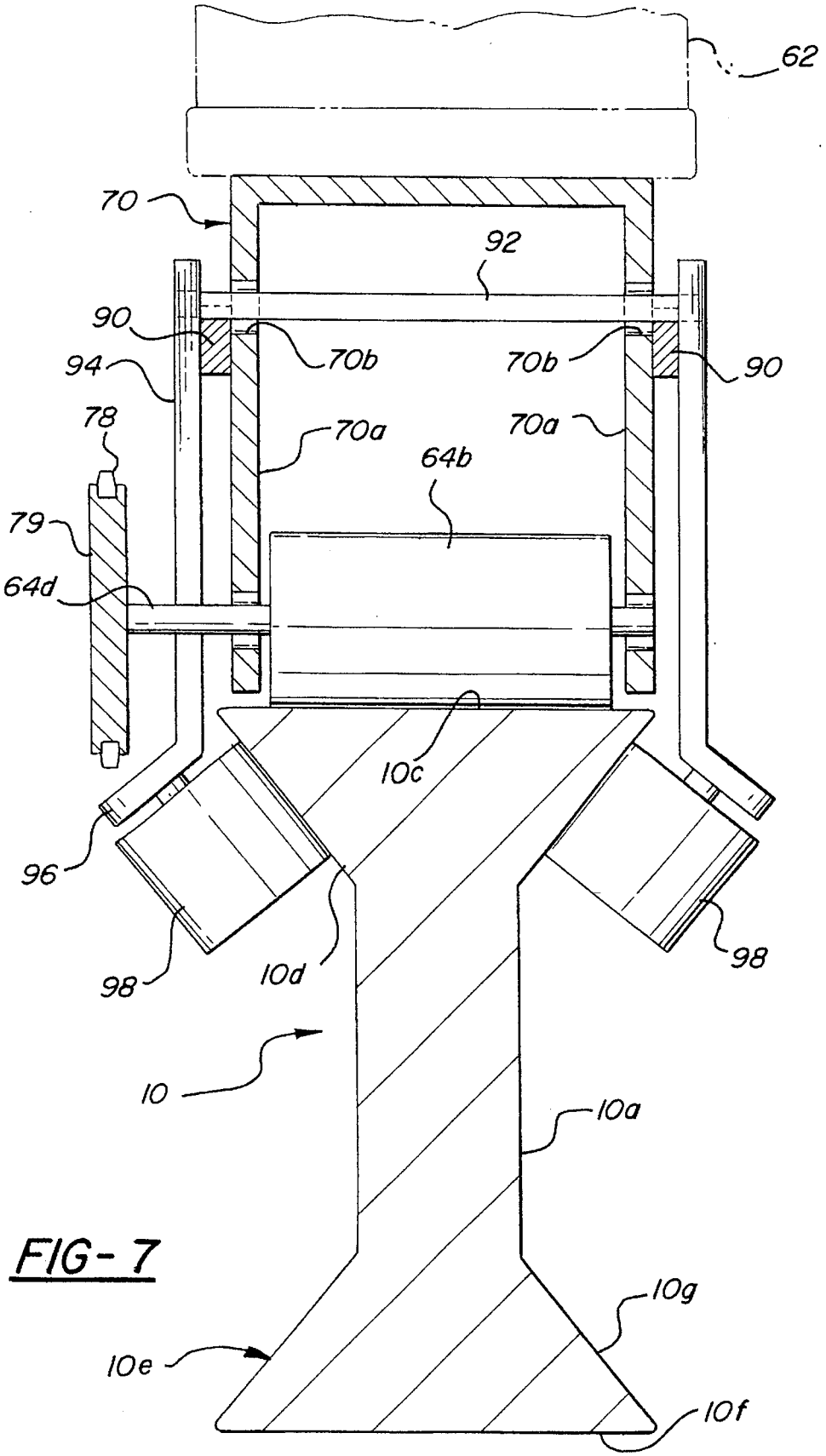
FIG. 7 is a cross-sectional view taken on line 7—7 of FIG. 6.

The material handling system seen in the drawings includes a rail 10 arranged in a desired predetermined configuration such for example as the closed loop seen in FIG. 1; one or more trains 12 arranged to run on the rail and each including a locomotive 14 pulling a plurality of trolley cars 16; at least one load station 17 and one unload station 18; a central dispatch CPU 19 located proximate but removed from the rail and communicating with a radio frequency transmitter 20; an information CPU 21 communicating with dispatch CPU 19 and including a printer 21*a*; and an input terminal 22. It will be understood that trains 12 move along rail 10 under the control of dispatch CPU 19 and selectively receive discrete products 22 at a load station 17, transport the products to an unload station 18, and discharge the products at the unload station. Rail 10 may take various forms and may, as best seen in FIGS. 6 and 7, have an I configuration including a central upstanding web 10*a*; an upper triangular portion 10*b* defining a flat upper traction surface 10*c* and opposite, angled downwardly converging clamping surfaces 10*d*; and a lower base portion 10*e* of triangular configuration including a lower support surface 10*f* and opposite, angled upwardly converging guide surfaces 10*g*. This invention relates to improvements in the locomotive 14 utilized to pull each train along the rail 10.

Figure 2:
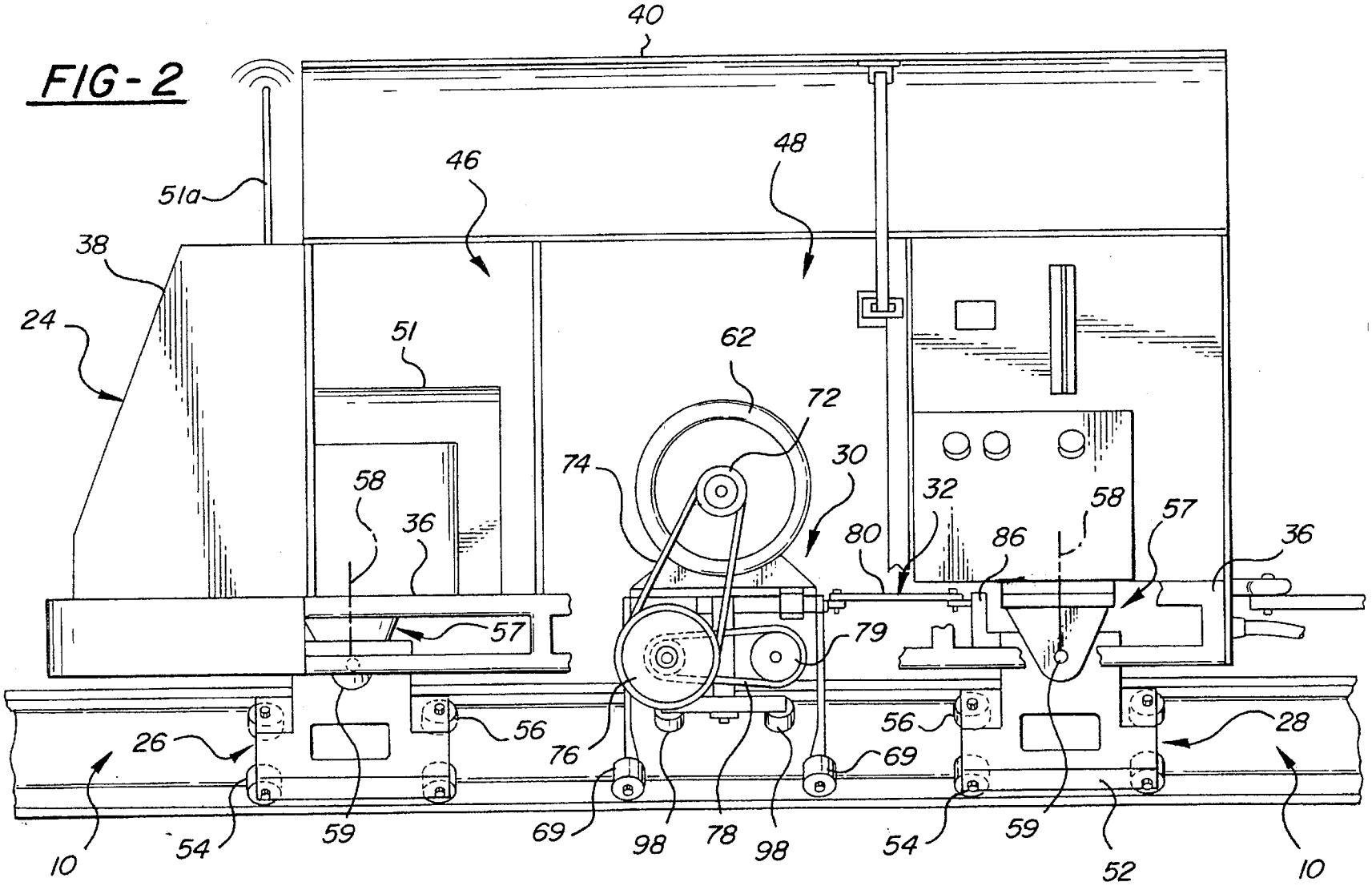
FIG. 2 is a detail view of a locomotive utilized in the material handling system of FIG. 1.
Figure 3:
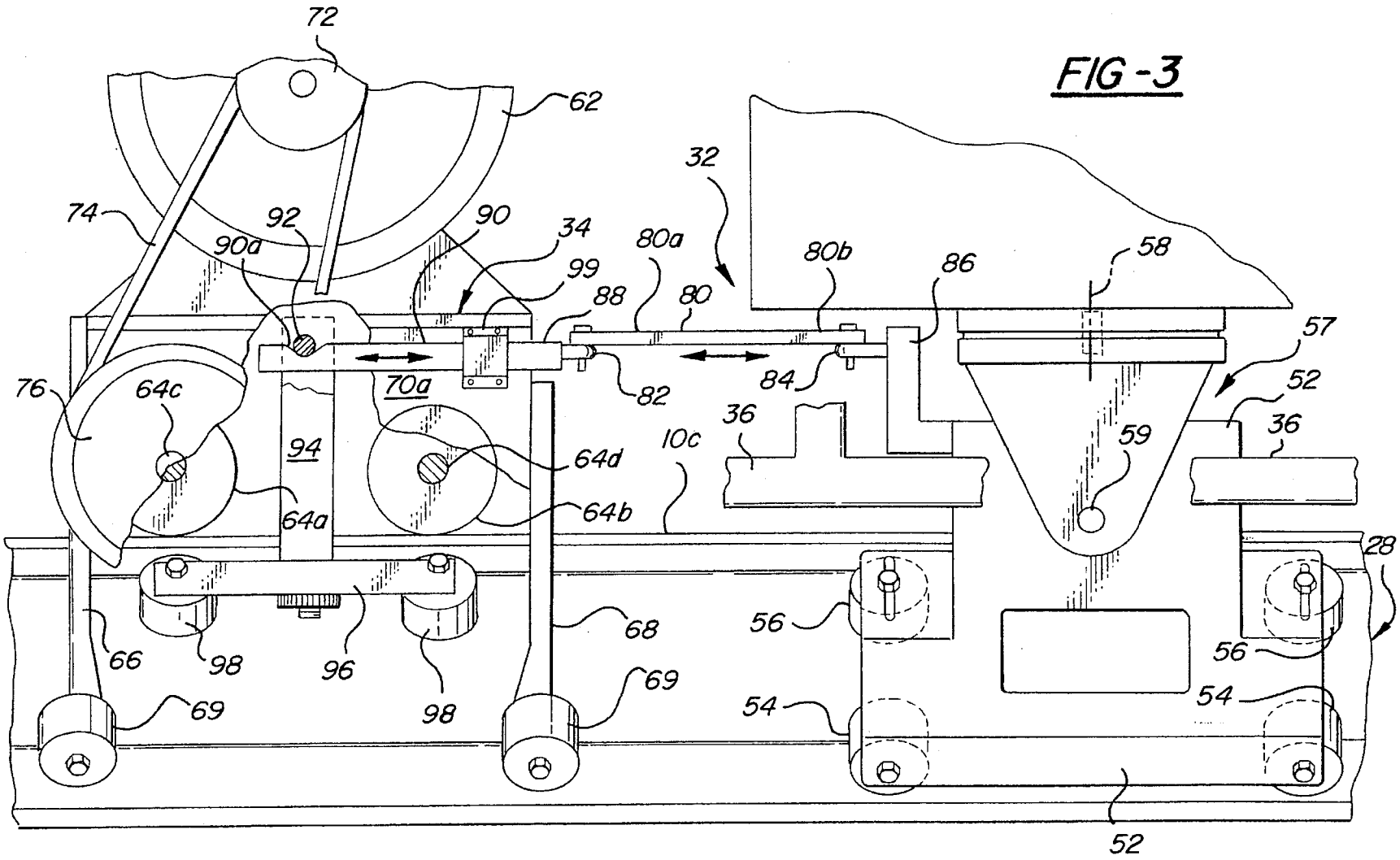
FIG. 3 is a fragmentary view of the locomotive of FIG. 2.

Locomotive 14 (FIGS. 2 and 3) includes a body structure 24, a front truck 26, a rear truck 28, a tractor 30, a connecting means 32, and a traction control mechanism 34.

Body structure 24 includes a perimeter frame 36 supporting a hollow downwardly opening body shell 38 positioned in surrounding relation to the perimeter frame and supported by the perimeter frame. Shell 38 includes gull wing doors 40 which pivot upwardly to provide access to the interior of the shell 38 for maintenance and repair purposes. Front and rear partitions 42,44 divide the interior volume of the shell 38 into a front compartment 46, a central compartment 48 and a rear compartment 50. Front and rear compartments 46 and 50 have floor structures so that the compartments, with doors 40 closed, are totally enclosed but central compartment. 48 is open at the bottom of the body structure and may therefore be readily accessed from beneath the body structure.

Compartments 46 and 50 house suitable electric control equipment for the locomotive and the associated train. For example, front compartment 46 may house a computer 51 and interface boards and rear compartment 50 may house a power supply for the trolley cars of the associated train, relays, and a variable frequency drive for the drive motor of tractor 30. Computer 51 maintains RF communication with transmitter/receiver 20, and thereby dispatch CPU 19, via an antenna 51*a*.

Front truck 26 includes a frame structure 52 of inverted U configuration positioned in straddling configuration over rail 10 with four lower guide rollers 54 (two on each side of the rail) rollably engaging rail guide surfaces 10*g* and four upper guide rollers 56 (two on each side of the rail) rollably engaging rail guide surfaces 10*d*. Front truck 26 is positioned beneath body structure 24 within perimeter frame 26 in underlying relation to front compartment 46 and is suitably connected to the floor structure of compartment 46, or to a cross member of frame 36, by a universal joint 57 so as to allow relative movement between the body structure and the truck about both a vertical axis 58 and a horizontal axis 59.

Rear truck 28 is identical to front truck 26 and includes a frame structure 52 straddling rail 10, lower guide rollers 54 rollably engaging rail guide surfaces 10*g*, and upper guide rollers 56 rollably engaging guide surfaces 10*d*. Rear truck 28 is positioned beneath body structure 24 within perimeter frame 36 in underlying relation to rear compartment 50 and is joined to the floor structure of compartment 50, or to a cross member of frame 36, by universal joint 57 so as to allow relative movement between the body structure and the truck about both a vertical axis 58 and a horizontal axis 59. It will be understood that the permitted relative movement between the body structure and the truck about a vertical axis allows the locomotive to negotiate rail curves and the permitted relative movement between the body structure and the truck about a horizontal axis allows the locomotive to negotiate rail inclines.

Tractor 30 includes a support structure 60, an electric motor 62, and traction drive wheels 64.

Support structure 60 includes front and rear inverted U-shaped yokes 66,68 and a frame structure Yokes 66,68 are positioned in straddling relation to the rail 10 and are mounted for rolling movement along the rail by guide rollers 69 rollably engaging guide surfaces 10*g*. Frame structure 70 has a generally box configuration and extends between front and rear yokes 66,68 to form the rigid body structure 60.

Motor 62 may comprise for example a three horsepower three-phase AC motor and is fixedly mounted on top of frame structure 70. Drive wheels 64 include front and rear wheels 64*a*, 64*b* positioned generally within frame structure 70 in driving, traction engagement with the upper surface 10*c* of rail 10. Traction wheels 64*a*, 64*b* include central drive shafts 64*c*, 64*d* journaled in side walls 70*a* of frame structure 70 and are driven from motor 62 by a drive train comprising a motor output pulley 72, an endless member 74 driven by pulley 72 and driving a pulley 76 mounted on shaft 64*c*, and an endless member 78 driven from shaft 64*c*and driving a pulley 79 mounted on shaft 64*d*. It will be seen that drive train 72–79 operates in response to energization of motor 62 to rotate traction wheels 64*a*, 64*b* in the same direction, either forwardly or backwardly, depending upon the direction of energization of the motor.

Tractor 30 will be seen to be positioned on rail 10 between front truck 26 and rear truck 28 and to extend upwardly from the rail 10 into downwardly opening compartment 48.

Connecting means 32 includes a link 80 pivotably or swively connected at its forward end 80*a* to a clevis 82 carried by the tractor and pivotably or swively connected at its rear end 80*b* to a clevis 84 carried by a bracket 86 upstanding from and secured to the frame structure 52 of rear truck 28. Link 80 enables the connecting means to operate (with the locomotive negotiating a straight rail section) to transmit forces to the locomotive subassembly only in directions substantially parallel to the direction of movement of the locomotive along the rail.

Traction control mechanism 34 includes a draw bar 88 mounting clevis 82 and positioned immediately rearwardly of tractor 30; a pair of cam bars 90 extending forwardly from opposite ends of draw bar 88 along opposite sides of tractor frame structure 70; a transverse cam follower bar 92 of circular cross section passing through vertical slots 70*b* in frame structure side walls 70*a*; vertical bars 94 secured to opposite ends of cam follower bar 92 and extending downwardly therefrom; a cross bar 96 positioned at the lower end of each vertical bar 94; and a pair of clamp wheels or rollers 98 journaled on front and rear ends of each bar 96 and rollably and clampingly engaging rail surfaces 10*d*. Cam bars 90 are guided in brackets 99 secured to frame side walls 70*a* and each bar defines a generally U-shaped cam surface 90*a* proximate the front end of the cam bar receiving a respective end of cam follower bar 92.

Figure 5A:
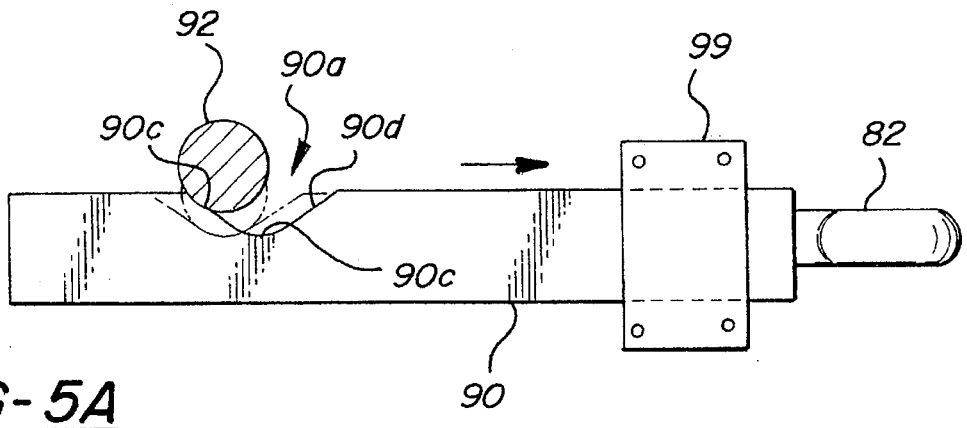
FIGS. 5A and 5B are detail views illustrating the operation of a traction control mechanism of the locomotive.
Figure 5B:
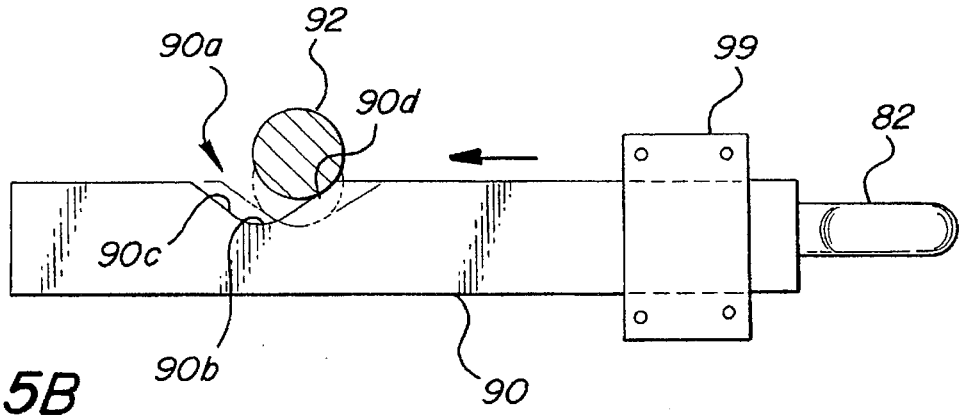

It will be seen that wheels 98 coact with traction wheels 64*a*, 64*b* to clamp the upper portion 10*b* of the rail therebetween and pull wheels 64*a*, 64*b* downwardly into frictional engagement with the upper traction surface 10*c* of the rail. It will further be seen that the magnitude of the clamping force and therefore the magnitude of the traction force generated between wheels 64*a*, 64*b* and rail surface 10*c* is varied in response to movement of cam follower rod 92 relative to cam surfaces 90*a*. Specifically, it will be seen that the traction force generated by the traction control means will be at a relatively lower value when cam follower bar 92 is positioned in the bottom or dwell portion 90*b* of the cam surfaces 90*a* (as seen in FIG. 6) and will increase as the cam follower moves upwardly (as seen in FIGS. 5A and 5B) along the rise portions 90*c*, 90*d* of the cam surfaces 90*a* in response to relative movement between the cam bars 90 and the cam follower 92.

Operation

Figure 4:
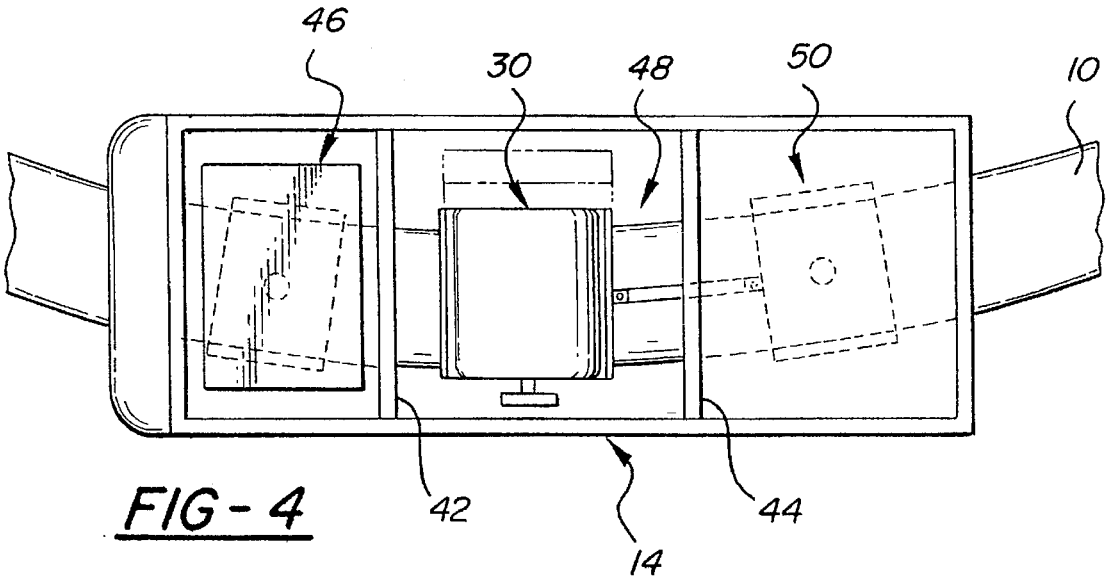
FIG. 4 is a somewhat schematic top view of the locomotive.

It will be understood that energization of motor 62 operates to move the tractor 30 along the rail 10 and thereby move the locomotive and the trailing trolley car 16 along the rail by virtue of the connecting link 80. It will be seen that the described arrangement effectively isolates the pulling and load carrying functions of the locomotive so that both functions may be optimized. Specifically, tractor 30 performs the pulling function and is connected to the remainder of the locomotive only by the link 80 so that the tractor is effectively disassociated from the body structure and need not be concerned with performing any kind of a load carrying function and so that static and dynamic load forces generated by the main body of the locomotive are not transmitted to the traction control or the drive wheels of the tractor with the result that the pull/push and locomotive weight force vectors are totally decoupled. This allows the tractor to have a very tight coupling geometry to the rail so that any normal horizontal or vertical track curve motion can be followed precisely by the tractor without the need to fight load and torque forces generated by the locomotive as it changes direction. Further, minor track size defects and roll orientations (undesired track rotation about its direction of travel axis) can be followed without transferring these back to the locomotive main body. Central locomotive compartment 48 has a width substantially exceeding the width of tractor 30 so that, as shown by the dash lines in FIG. 4, the tractor 30 is free to move laterally relative to the body structure of the locomotive to negotiate curves in the rail so that each of the trucks and the tractor may seek its own path of least resistance along the rails as the rails curve. This isolates the body structure and integrated controls from much of the vibration and impact loads generated by the operation of the tractor. This also has the effect of minimizing the amount of swing imparted to the body structure of the locomotive as the locomotive negotiates curves. This greatly simplifies installation of the material handling system since it minimizes concerns with respect to impacts between the locomotive and track side obstacles or personnel.

As the locomotive accelerates, or moves up an incline in the track such as the incline seen at 10*a* in FIG. 1, traction control mechanism 34 functions to increase the frictional force between the drive rollers 64*a*, 64*b* and the track, and thereby increase the pulling power of the locomotive, as the result of movement of cam bars 90 rearwardly relatively to cam follower 92 by virtue of the draft load exerted on draw bar 88 via link 80. This relative rearward movement of the cam bars 90 has the effect (FIG. 5A) of walking cam follower bar 92 up cam rise portions 90*c* to impart vertical movement to vertical bars 94 and thereby move rollers 98 upwardly with respect to the rail to increase the clamping or squeezing action exerted on the rail by the coaction of the rollers 98 and drive rollers 64*a*, 64*b*.

Conversely, when the locomotive is braking, or moving down hill, the draft load generated by the associated train and transmitted to the locomotive by link 80 and draw bar 88 has the effect of moving the draw bars 90 forward relative to the cam follower bar 92 (FIG. 5B) with the result that the cam follower bar 92 walks up the cam rise portions 90*d* and again causes the rollers to move upwardly into tighter relationship with the track to increase the clamping and traction force.

The invention locomotive and associated material handling system will be seen to provide many important advantages. Specifically, the invention locomotive construction isolates the static and dynamic load forces generated by the main body of the locomotive from the power unit of the locomotive; allows the power module to have a very tight coupling geometry to the rail so that any normal horizontal or vertical track curve motion can be followed precisely by the locomotive without the need to fight load and torque forces generated by the locomotive as it changes direction; allows minor track size defects and roll orientations to be followed without transferring these back to the locomotive main body; provides a single point of mechanical contact to the rear truck of the locomotive so as to provide one axis coupling and therefore no up/down, left/right, or rotational torque transmission between the tractor and the main body of the locomotive; enables the drive means to operate, with the locomotive negotiating a straight rail section, to transmit forces to the locomotive main body only in directions substantially parallel to the direction of movement of the locomotive along the rail, facilitates modular construction of the locomotive; allows a family of tractors with different power sizes and characteristics to be provided; facilitates the provision of a simple and effective traction control mechanism for the locomotive; allows the tractor to be covered and protected by the shell of the locomotive for safety and aesthetic advantages so that the tractor does not need its own case or shielding; and minimizes swing of the locomotive on curves so as to minimize concerns with respect to track side equipment or personnel.

Whereas a preferred embodiment of the invention has been illustrated and described in detail, it will be apparent that various changes may be made in the disclosed embodiment without departing from the scope or spirit of the invention.

We claim:

1. A locomotive for a material handling train comprising:

a locomotive subassembly comprising a truck adapted for movement along a rail and a body structure defining a hollow and mounted on the truck;

a tractor positioned within the hollow of the body structure, disassociated from the body structure and free to move laterally relative to the body structure, and including a motor and a traction drive wheel driven by the motor and adapted to drivingly engage the rail; and drive means pivotally and drivingly interconnecting the tractor and the truck.

2. A locomotive according to claim 1 wherein the drive means is operative, with the locomotive negotiating a straight section of the rail, to transmit forces to the truck only in directions substantially parallel to the direction of movement of the locomotive along the rail.

3. A locomotive according to claim 2 wherein the drive means comprises a link pivotally connected at one end thereof to the tractor and pivotally connected at another end thereof to the truck.

4. A locomotive for a material handling train comprising:

a front truck adapted for movement along a rail;

a rear truck adapted for movement along the rail in spaced, trailing relation to the front truck;

a body structure mounted on and extending between the front and rear trucks;

a tractor positioned between the front and rear trucks, disassociated from the body structure and free to move laterally relative to the body structure, and including a motor and a traction drive wheel driven by the motor and adapted to drivingly engage the rail; and drive means pivotally and drivingly interconnecting the tractor and one of the trucks.

5. A locomotive according to claim 4 wherein the drive means interconnects the tractor and the rear truck.

6. A locomotive according to claim 4 wherein the drive means is operative, with the locomotive negotiating a straight section of the rail, to transmit forces to the rear truck only in directions substantially parallel to the direction of movement of the locomotive along the rail.

7. A locomotive according to claim 4 wherein:

the body structure defines a downwardly opening compartment between the front and rear trucks; and the tractor is positioned in the compartment.

8. A locomotive for a material handling train comprising:

a front truck adapted for movement along a rail;

a rear truck adapted for movement along the rail in spaced, trailing relation to the front truck;

a body structure mounted on and extending between the front and rear trucks;

a tractor positioned between the front and rear trucks, disassociated from the body structure, and including a motor and a traction drive wheel driven by the motor and adapted to drivingly engage the rail; and drive means disassociated from the body structure and pivotally and drivingly interconnecting the tractor and the rear truck.

9. A locomotive according to claim 8 wherein:

the body structure defines a downwardly opening compartment between the front and rear trucks; and the tractor is positioned in the compartment.

10. A locomotive according to claim 9 wherein the traction drive wheel is adapted to drivingly engage an upper surface of the rail and the tractor further includes a guide wheel positioned in opposition to the drive wheel and adapted to drivingly engage an undersurface of the rail to thereby clamp the rail between the drive wheel and the guide wheel.

11. A locomotive according to claim 8 wherein each of the front and rear trucks is connected to the body structure by a connection that allows pivotal movement about a horizontal axis generally normal to the lengthwise axis of the locomotive, whereby to allow the locomotive to negotiate rail inclines.

12. A locomotive according to claim 8 wherein each of the front and rear trucks is connected to the body structure by a connection that allows pivotal movement about a vertical axis, whereby to allow the locomotive to negotiate rail curves.

13. A locomotive according to claim 8 wherein the locomotive further includes traction control means operative in response to variations in the force exerted on the tractor via the drive means to correspondingly vary the traction force between the drive wheel and the rail.

14. A locomotive according to claim 13 wherein:

the drive wheel is adapted to engage one surface of the rail;

the tractor further includes a guide wheel adapted to engage an opposite surface of the rail and thereby clamp the rail between the drive wheel and the guide wheel; and the traction control means is operative to vary the clamping force exerted on the rail by the drive wheel and the guide wheel.

15. A locomotion system for material handling comprising:

a rail; and a locomotive including:

a front truck mounted for movement along the rail;

a rear truck mounted for movement along the rail in spaced, trailing relation to the front truck;

a body structure mounted on and extending between the front and rear trucks in overlying relation to the rail;

a tractor mounted on the rail between the front and rear trucks, disassociated from the body structure, and including a motor and a drive wheel driven by the motor and drivingly engaging the rail to thereby propel the tractor along the rail; and drive means disassociated from the body structure and pivotally and drivingly interconnecting the tractor and one of the trucks whereby propulsion of the tractor along the rail propels the locomotive along the rail.

16. A locomotion system according to claim 15 wherein the drive means interconnects the tractor and the rear truck.

17. A locomotive for a material handling train comprising:

a tractor including a motor, a drive wheel driven by the motor and adapted to engage a first surface of a rail, and an opposing guide wheel adapted to drivingly engage a second surface of the rail opposed to the first surface, the drive wheel and the guide wheel coacting to exert a clamping force on the rail and propel the tractor and an associated material handling train along the rail; and traction control means operative in response to variations in the draft load applied to the tractor by the associated train to vary the clamping force; wherein the traction control means includes a draw bar mounted on the tractor, receiving the draft load, and moveable relative to the tractor in response to variations in the draft load; and the traction control means is operative to vary the clamping force in response to movement of the draw bar relative to the tractor.

18. A locomotive for a material handling train comprising:

a locomotive subassembly comprising a truck adapted for movement along a rail and a body structure mounted on the truck and defining a hollow comprising a downwardly opening compartment defined forwardly of the truck;

a tractor positioned within the compartment, free to move laterally relative to the body structure, and including a motor and a traction drive wheel driven by the motor and adapted to drivingly engage the rail; and drive means drivingly interconnecting the tractor and the locomotive subassembly and including a link having a front end pivotally connected to the tractor and a rear end pivotally connected to the truck.

19. A locomotive for a material handling train comprising:

a locomotive subassembly comprising:

a front truck adapted for movement along a rail;

a rear truck adapted for movement along the rail in spaced, trailing relation to the front truck; and a body structure mounted on and extending between the front and rear trucks;

a tractor positioned between the front and rear trucks, free to move laterally relative to the body structure, and including a motor and a traction drive wheel driven by the motor and adapted to drivingly engage the rail; and drive means drivingly interconnecting the tractor and the locomotive subassembly and including a link pivotally connected at its front end to the tractor and pivotally connected at its rear end to the rear truck.

20. A locomotive for a material handling train comprising:

a front truck adapted for movement along a rail;

a rear truck adapted for movement along the rail in spaced, trailing relation to the front truck;

a body structure mounted on and extending between the front and rear trucks;

a tractor positioned between the front and rear trucks, disassociated from the body structure, and including a motor and a traction drive wheel driven by the motor and adapted to drivingly engage the rail; and drive means drivingly interconnecting the tractor and the rear truck and including a link pivotally connected at its front end to the tractor and pivotally connected at its rear and to the rear truck.

21. A locomotion system for material handling comprising:

a rail; and a locomotive including:

a front truck mounted for movement along the rail;

a rear truck mounted for movement along the rail in spaced, trailing relation to the front truck;

a body structure mounted on and extending between the front and rear trucks in overlying relation to the rail;

a tractor mounted on the rail between the front and rear trucks, disassociated from the body structure, and including a motor and a drive wheel driven by the motor and drivingly engaging the rail to thereby propel the tractor along the rail; and drive means drivingly interconnecting the tractor and the rear truck and including a link pivotally connected at its front end to the tractor and pivotally connected at its rear end to the rear truck.

22. A locomotion system according to claim 15 wherein:

the body structure defines a downwardly opening compartment between the front and rear trucks; and the tractor is positioned on the rail and extends upwardly into the compartment.

23. A locomotion system for material handling comprising:

a rail; and a locomotive including:

a front truck mounted for movement along the rail;

a rear truck mounted for movement along the rail in spaced, trailing relation to the front truck;

a body structure mounted on and extending between the front and rear trucks in overlying relation to the rail and defining a downwardly opening compartment between the front and rear trucks;

a tractor mounted on the rail between the front and rear trucks, extending upwardly into the compartment, disassociated from the body structure, and including a motor and a drive wheel driven by the motor and drivingly engaging the rail to thereby propel the tractor along the rail; and drive means comprising an articulated connection drivingly interconnecting the tractor and one of the trucks whereby propulsion of the tractor along the rail propels the locomotive along the rail;

the compartment having a width exceeding the width of the tractor so that the tractor is free to move laterally within the compartment relative to the body structure as the locomotive negotiates rail curves.

24. A locomotion system according to claim 23 wherein:

said one truck is said rear truck; and the articulated connection includes a link pivotally connected at its front end to the tractor and pivotally connected at its rear end to the rear truck.

25. A locomotive for a material handling train comprising:

a front truck adapted for movement along a rail;

a rear truck adapted for movement along the rail in spaced, trailing relation to the front truck;

a body structure mounted on and extending between the front and rear trucks;

a tractor positioned between the front and rear trucks, disassociated from the body structure, and including a motor and a traction drive wheel driven by the motor and adapted to drivingly engage the rail; and drive means drivingly interconnecting the tractor and one of the trucks;

the locomotive further including traction control means operative in response to variations in the force exerted on the tractor via the drive means to correspondingly vary the traction force between the drive wheel and the rail;

the drive wheel being adapted to engage one surface of the rail;

the tractor further including a guide wheel adapted to engage an opposite surface of the rail and thereby clamp the rail between the drive wheel and the guide wheel;

the traction control means being operative to vary the clamping force exerted on the rail by the drive wheel and the guide wheel;

the locomotive being adapted to pull a train along the rail;

the drive means including a draw bar mounted on the tractor, receiving the draft load from the train, and moveable relative to the tractor in response to variations in the drive load;

the traction control means being operative to vary the clamping force in response to movement of the draw bar relative to the tractor.

26. A locomotive according to claim 25 wherein:

the drive wheel rollably engages an upper surface of the rail;

the guide wheel rollably engages an undersurface of the rail; and the traction control means is operative to vary the clamping force by raising and lowering the guide wheel relative to the drive wheel.

27. A locomotive according to claim 25 wherein:

the traction control means includes a cam bar secured to the draw bar and defining a cam surface and a cam follower connected to the guide wheel and coacting with the cam surface in response to movement of the draw bar relative to the tractor to raise and lower the guide wheel and thereby vary the clamping force.

28. A locomotive for a material handling train comprising:

a tractor including a motor, a drive wheel driven by the motor and adapted to engage a first surface of a rail, and an opposing guide wheel adapted to drivingly engage a second surface of the rail opposed to the first surface, the drive wheel and the guide wheel coacting to exert a clamping force on the rail and propel the tractor and an associated material handling train along the rail; and traction control means operative in response to variations in the draft load applied to the tractor by the associated train to vary the clamping force;

the traction control means including a draw bar mounted on the tractor, receiving the draft load, and moveable relative to the tractor in response to variations in the draft load;

the traction control means being operative to vary the clamping force in response to movement of the draw bar relative to the tractor;

the traction control means further including a cam bar connected to one of the draw bar or the guide wheel and defining a cam surface and a cam follower connected to the other of the draw bar or the guide wheel and coacting with the cam surface in response to movement of the draw bar relative to the tractor to raise and lower the guide wheel and thereby vary clamping force.

29. A locomotive according to claim 28 wherein the cam bar is connected to the draw bar and the cam follower is connected to the guide wheel.

30. A locomotive according to claim 28 wherein the cam surface comprises a central dwell portion and first and second rise portions on opposite sides of the central dwell portion and the cam follower comprises a pin or roller engaging the cam surface.

31. A locomotive according to claim 30 wherein the pin or roller moves up the first rise portion in response to acceleration forces or upward incline generated forces and moves up the second rise portion in response to deceleration forces or downward incline generated forces.

* * * * *